US011148013B2

(12) United States Patent
Molinari et al.

(10) Patent No.: US 11,148,013 B2
(45) **Date of Patent: *Oct. 19, 2021**

(54) SPORTS BALL

(71) Applicant: NIKE, Inc., Beaverton, OR (US)

(72) Inventors: Arthur Parker Molinari, Portland, OR (US); Todd Smith, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/523,191

(22) Filed: Jul. 26, 2019

(65) Prior Publication Data

US 2020/0070011 A1 Mar. 5, 2020

Related U.S. Application Data

(60) Provisional application No. 62/725,685, filed on Aug. 31, 2018.

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01); *A63B 2209/00* (2013.01)

(58) Field of Classification Search
CPC ..... A63B 41/08; A63B 2209/00; A63B 45/00; A63B 2243/0025; A63B 2243/0037; A63B 41/10
See application file for complete search history.

(56) References Cited

U.S. PATENT DOCUMENTS 1,931,429 A * 10/1933 Buckner ..... A63B 41/08 473/596
2,182,052 A 12/1939 Reach
(Continued)

FOREIGN PATENT DOCUMENTS

BE 1016122 A6 3/2006
EP 0885636 A1 12/1998
(Continued)

OTHER PUBLICATIONS

Adrian L. Kiratidis and Derek B. Leinweber, An Aerodynamic Analysis of Recent FIFA World Cup Balls, Special Research Centre for the Subatomic Structure of Matter, Department of Physics, The University of Adelaide, SA, 5005, Australia, Feb. 20, 2018.
(Continued)

*Primary Examiner* — Steven B Wong
(74) *Attorney, Agent, or Firm* — Quinn IP Law

(57) ABSTRACT

An inflatable sports ball having a bladder and a cover disposed about the bladder in provided. The cover may have an exterior surface that defines a plurality of plateau sections, a first plurality of indentations, and a second plurality of indentations that cooperate to define a topographical arrangement across the exterior surface. Each of the first plurality of indentations has a first indentation depth, a first indentation width, and a first maximum aspect ratio. The first maximum aspect ratio is defined as the ratio of the first indentation width to the first indentation depth. The second plurality of indentations has a second indentation depth, a second indentation width, and a second maximum aspect ratio. The second maximum aspect ratio is defined as the ratio of the second indentation width to the second indentation depth. The second maximum aspect ratio is greater than the first maximum aspect ratio.

18 Claims, 6 Drawing Sheets

(56) References Cited

U.S. PATENT DOCUMENTS

| | | | | |
|---|---|---|---|---|
| 2,245,115 | A | 6/1941 | Reach | |
| 2,859,040 | A | 11/1958 | Gow | |
| 3,512,777 | A | 5/1970 | Henderson | |
| 4,318,544 | A | 3/1982 | Brine, Jr. | |
| 4,337,944 | A | 7/1982 | Massino | |
| 4,542,902 | A | 9/1985 | Massino | |
| 4,736,948 | A | 4/1988 | Thomas | |
| 4,928,962 | A | 5/1990 | Finley | |
| 4,991,842 | A | 2/1991 | Finley | |
| 5,354,053 | A | 10/1994 | Ratner et al. | |
| D357,958 | S | 5/1995 | Audero, Jr. | |
| 5,427,372 | A | 6/1995 | Ratner et al. | |
| 5,451,046 | A | 9/1995 | Batton | |
| 5,518,234 | A | 5/1996 | Palmquist | |
| 5,683,316 | A | 11/1997 | Campbell | |
| 5,735,761 | A | 4/1998 | Palmquist | |
| 5,851,161 | A | 12/1998 | Sassak | |
| D408,876 | S | 4/1999 | Feeney | |
| 5,931,752 | A * | 8/1999 | Guenther | A63B 41/08 473/597 |
| 5,984,812 | A | 11/1999 | Sassak | |
| 6,012,997 | A | 1/2000 | Mason | |
| 6,283,881 | B1 | 9/2001 | Feeney | |
| 6,302,815 | B1 | 10/2001 | Shishido et al. | |
| 6,406,389 | B1 * | 6/2002 | Feeney | A63B 41/08 473/596 |
| 6,422,961 | B1 * | 7/2002 | Feeney | A63B 41/08 473/596 |
| 6,503,162 | B1 | 1/2003 | Shishido et al. | |
| 6,685,585 | B2 | 2/2004 | Shishido et al. | |
| 6,988,969 | B2 | 1/2006 | Avis | |
| 7,300,357 | B2 | 11/2007 | Breaker et al. | |
| 7,614,959 | B1 | 11/2009 | Gentile | |
| 7,654,880 | B2 | 2/2010 | Schneider | |
| 7,854,671 | B2 | 12/2010 | Lalvani | |
| 8,002,652 | B2 | 8/2011 | Wong | |
| 8,182,379 | B2 | 5/2012 | Rapaport et al. | |
| 8,216,098 | B2 | 7/2012 | Lalvani | |
| 8,262,519 | B2 | 9/2012 | Raynak et al. | |
| 8,371,971 | B2 | 2/2013 | Bevier | |
| 8,529,386 | B2 | 9/2013 | Nuernberg et al. | |
| 8,579,743 | B2 | 11/2013 | Cohen et al. | |
| 8,597,144 | B2 | 12/2013 | Chang et al. | |
| 8,608,599 | B2 | 12/2013 | Raynak et al. | |
| 8,617,011 | B2 | 12/2013 | Berggren et al. | |
| 8,672,783 | B2 | 3/2014 | Fujikura et al. | |
| 8,684,870 | B2 | 4/2014 | Ito et al. | |
| 8,708,847 | B2 | 4/2014 | Berggren et al. | |
| 8,777,787 | B2 | 7/2014 | Raynak et al. | |
| 8,845,466 | B2 | 9/2014 | Bevier | |
| 8,852,039 | B2 | 10/2014 | White et al. | |
| 8,926,459 | B2 | 1/2015 | Berggren et al. | |
| 8,974,330 | B2 | 3/2015 | Berggren et al. | |
| 9,149,701 | B1 | 10/2015 | Bramlette | |
| 9,254,424 | B2 | 2/2016 | Berggren et al. | |
| 9,272,190 | B2 | 3/2016 | Tompkins | |
| 9,327,167 | B2 | 5/2016 | Raynak et al. | |
| 9,370,693 | B2 | 6/2016 | Berggren et al. | |
| 9,370,695 | B2 | 6/2016 | Chang et al. | |
| 9,452,322 | B2 | 9/2016 | Thurman et al. | |
| 9,457,239 | B2 | 10/2016 | White et al. | |
| 9,457,525 | B2 | 10/2016 | Berggren et al. | |
| 9,468,815 | B2 | 10/2016 | Berggren et al. | |
| 9,486,675 | B1 | 11/2016 | White | |
| 9,504,880 | B2 | 11/2016 | Bevier | |
| 9,539,473 | B2 | 1/2017 | Berggren et al. | |
| D786,374 | S | 5/2017 | Deaton et al. | |
| D786,375 | S | 5/2017 | Deaton et al. | |
| 9,694,247 | B2 | 7/2017 | Nurnberg | |
| 9,814,941 | B2 | 11/2017 | Cohen et al. | |
| 9,821,195 | B2 | 11/2017 | Raynak et al. | |
| 9,855,469 | B2 | 1/2018 | Berggren et al. | |
| 9,884,227 | B2 | 2/2018 | Berggren et al. | |
| 9,919,483 | B2 | 3/2018 | Nurnberg | |
| 10,016,935 | B2 | 7/2018 | Berggren et al. | |
| D863,473 | S | 10/2019 | Smith | |
| D863,474 | S | 10/2019 | Smith | |
| 2004/0142780 | A1 | 7/2004 | Estefano | |
| 2006/0105866 | A1 | 5/2006 | Ma | |
| 2006/0205544 | A1 | 9/2006 | Wyner et al. | |
| 2006/0229150 | A1 | 10/2006 | Ou | |
| 2007/0117662 | A1 | 5/2007 | Ma | |
| 2008/0032834 | A1 * | 2/2008 | Krysiak | A63B 41/08 473/597 |
| 2008/0287218 | A1 | 11/2008 | Freund | |
| 2009/0042659 | A1 | 2/2009 | Breaker et al. | |
| 2009/0325742 | A1 * | 12/2009 | Krysiak | A63B 41/08 473/596 |
| 2010/0255940 | A1 * | 10/2010 | Nuernberg | A63B 41/08 473/604 |
| 2011/0012309 | A1 | 1/2011 | Schreff | |
| 2011/0152018 | A1 | 6/2011 | Walling et al. | |
| 2011/0250819 | A1 | 10/2011 | Tashman | |
| 2011/0250997 | A1 | 10/2011 | Walling et al. | |
| 2012/0142465 | A1 * | 6/2012 | Berggren | A63B 45/00 473/604 |
| 2012/0172160 | A1 * | 7/2012 | Marc | B29C 65/24 473/604 |
| 2013/0005520 | A1 * | 1/2013 | Chang | B29C 65/4815 473/604 |
| 2013/0059683 | A1 * | 3/2013 | Krysiak | A63B 41/02 473/597 |
| 2013/0260927 | A1 * | 10/2013 | Thurman | A63B 41/00 473/595 |
| 2014/0038741 | A1 | 2/2014 | Brooks | |
| 2014/0179468 | A1 | 6/2014 | Berggren et al. | |
| 2014/0179469 | A1 * | 6/2014 | Berggren | A63B 41/08 473/604 |
| 2015/0367183 | A1 | 12/2015 | Ou | |
| 2016/0082323 | A1 | 3/2016 | Higa et al. | |
| 2016/0089580 | A1 | 3/2016 | Nurnberg | |
| 2016/0243408 | A1 | 8/2016 | Tompkins | |
| 2016/0263444 | A1 * | 9/2016 | Nurnberg | A63B 43/004 |
| 2016/0287948 | A1 * | 10/2016 | Berggren | A63B 45/00 |
| 2016/0288438 | A1 | 10/2016 | Chang et al. | |
| 2016/0346627 | A1 | 12/2016 | Le et al. | |
| 2016/0346964 | A1 | 12/2016 | Nurnberg et al. | |
| 2017/0050089 | A1 | 2/2017 | Olivares Velasco | |
| 2017/0246512 | A1 | 8/2017 | Berggren et al. | |
| 2017/0291076 | A1 * | 10/2017 | Campbell | A63B 41/08 |
| 2017/0354851 | A1 | 12/2017 | Lyon | |
| 2018/0078827 | A1 * | 3/2018 | Berggren | A63B 45/00 |
| 2018/0111024 | A1 | 4/2018 | Ou | |
| 2018/0133562 | A1 * | 5/2018 | Berggren | A63B 45/02 |
| 2018/0154220 | A1 | 6/2018 | Campbell | |
| 2018/0161636 | A1 | 6/2018 | Ahmed | |
| 2018/0169483 | A1 | 6/2018 | Ou | |
| 2018/0200969 | A1 | 7/2018 | Nurnberg | |
| 2018/0243614 | A1 * | 8/2018 | Berggren | A63B 41/08 |
| 2018/0243615 | A1 | 8/2018 | Berggren et al. | |
| 2018/0339202 | A1 * | 11/2018 | Molinari | A63B 41/02 |
| 2019/0184242 | A1 | 6/2019 | Molinari | |
| 2020/0070011 | A1 * | 3/2020 | Molinari | A63B 41/08 |
| 2020/0070012 | A1 * | 3/2020 | Molinari | A63B 45/02 |
| 2020/0171359 | A1 * | 6/2020 | Molinari | A63B 41/02 |
| 2020/0230468 | A1 * | 7/2020 | Molinari | A63B 41/08 |

FOREIGN PATENT DOCUMENTS

| | | | | |
|---|---|---|---|---|
| GB | 2375054 | A * | 11/2002 | A63B 41/08 |
| GB | 2447845 | A | 10/2008 | |
| WO | 2005115561 | A1 | 12/2005 | |

OTHER PUBLICATIONS

F. Alam, H. Chowdhury, B. Loganathan, I. Mustary and S. Watkins, Aerodynamic Drag of Contemporary Soccer Balls, 19th Australasian Fluid Mechanics Conference, Melbourne, Australia, Dec. 2014.

Firoz Alam, Harun Chowdhury, Mark Stemmer, Zilong Wang and Jie Yang, Effects of surface structure on soccer ball aerodynamics,

(56) References Cited

OTHER PUBLICATIONS

Procedia Engineering 34 (2012) pp. 146-151, Published by Elsevier Ltd.
John Eric Goff, Matt J. Carre, Investigations into soccer aerodynamics via trajectory analysis and dust experiments, Procedia Engineering 34 (2012) pp. 158-163, Published by Elsevier Ltd.
John Eric Goff, Sungchan Hong and Takeshi Asai, Aerodynamic and surface comparisons between Telstar 18 and Brazuca, Journal of Sports Engineering and Technology, 2018, pp. 1-7, DOI: 10.1177/1754337118773214.
Luca Oggiano, Lars Saetran, Aerodynamics of modern soccer balls, Procedia Engineering 2 (2010) pp. 2473-2479, Published by Elsevier Ltd.
Pouya Jalilian, Patrick K. Kreun, Mohammadhady M. Makhmalbaf and William W. Liou, Computational Aerodynamics of Baseball, Soccer Ball and Volleyball, American Journal of Sports Science, vol. 2, No. 5, 2014, pp. 115-121, doi: 10.11648/j.ajss.20140205.12.
Sungchan Hong and Takeshi Asai, Aerodynamic effects of dimples on soccer ball surfaces, Heliyon 3 (2017) e00432, doi: 10.1016/j.heliyon.2017.e00432.
Sungchan Hong and Takeshi Asai, Effect of panel shape of soccer ball on its flight characteristics, Sci. Rep. 4, 5068; DOI:10.1038/srep05068 (2014).
T. Asai, K. Seo, O. Kobayashi and R. Sakashita, Fundamental aerodynamics of the soccer ball, Sports Engineering (2007) 10, pp. 101-110.
Takeshi Asai, Kazuya Seo, Aerodynamic drag of modern soccer balls, SpringerPlus 2013, 2:171, Published Apr. 19, 2013.

* cited by examiner

SPORTS BALL

CROSS-REFERENCE TO RELATED APPLICATIONS

This application claims the benefit of U.S. Provisional Application No. 62/725,685, filed Aug. 31, 2018, which is hereby incorporated by reference in its entirety.

TECHNICAL FIELD

The disclosure relates to inflatable sports balls.

BACKGROUND

A variety of inflatable sport balls, such as a soccer ball, conventionally exhibit a layered structure that includes a casing, an intermediate structure, and a bladder. The casing forms an exterior portion of the sports ball and is generally formed from a plurality of durable and wear-resistant panels joined together along abutting edge areas (e.g., with stitching, adhesives, or bonding), i.e., via a seam. Designs such as decorative elements and holistic textural patterns may be applied to the exterior surface of the casing. Decorative elements are conventionally applied via processes such as thermal transfer films or a release paper. Textural patterns are conventionally applied via processes such as embossing, debossing, stamping, molding, or laser etching.

The intermediate structure forms a middle portion of the sport ball and is positioned between the casing and the interior. Among other purposes, the intermediate structure may provide a softened feel to the sport ball, impart energy return, and restrict expansion of the bladder. In some configurations, the intermediate structure or portions of the intermediate structure may be bonded, joined, or otherwise incorporated into the casing as a backing material. In other configurations, the intermediate structure or portions of the intermediate structure may be bonded, joined, or otherwise incorporated into the interior.

SUMMARY

A sports ball is provided. The sports ball may include an interior bladder and a cover disposed about the interior bladder. The cover may comprise a plurality of adjoining panels. The cover may further define an exterior surface. The cover may have an outer substrate layer that defines a plurality of plateau sections, a first plurality of indentations, and a second plurality of indentations. The plateaus may be disposed between the indentations, such that the indentations and the plateaus cooperate to define a topographical arrangement upon the exterior surface of the cover.

The first plurality of indentations may be defined as a plurality of seams configured to adjoin the plurality of panels or a plurality of depressions, such as pseudo seams. Each of the first plurality of indentations has a first maximum aspect ratio.

The second plurality of indentations may be defined as a plurality of channels. Each channel has a second maximum aspect ratio. The second maximum aspect ratio is greater than the first maximum aspect ratio.

DETAILED DESCRIPTION

Figure 1:
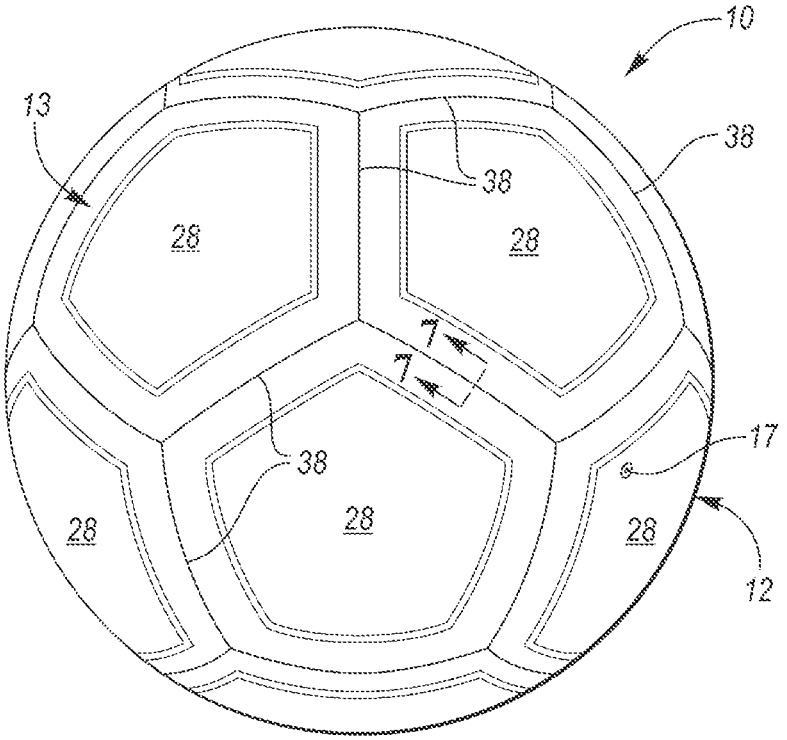
FIG. 1 is a schematic perspective view of an example inflatable sports ball.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "a," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various sports ball configurations and methods relating to manufacturing of the sport balls. Although the sports ball is depicted as a soccer ball in the associated Figures, concepts associated with the configurations and methods may be applied to various types of inflatable sport balls, such as basketballs, footballs (for either American football or rugby), volleyballs, water polo balls, etc. and a variety of non-inflatable sports balls, such as baseballs and softballs, may also incorporate concepts discussed herein.

Referring to the drawings, wherein like reference numerals refer to like components throughout the several views, a sports ball 10 is provided. In a general sense, the sports ball 10 of the present disclosure includes a plurality of outer panels that each have an undulating or wave-like topographical surface design or texture. The undulating or wave-like topographical design is formed via indentations having a greater width to depth aspect ratio than that of a bounding seam or pseudo seam. Such a configuration has been found to provide aerodynamic consistency that is improved from conventional designs.

Figure 2:
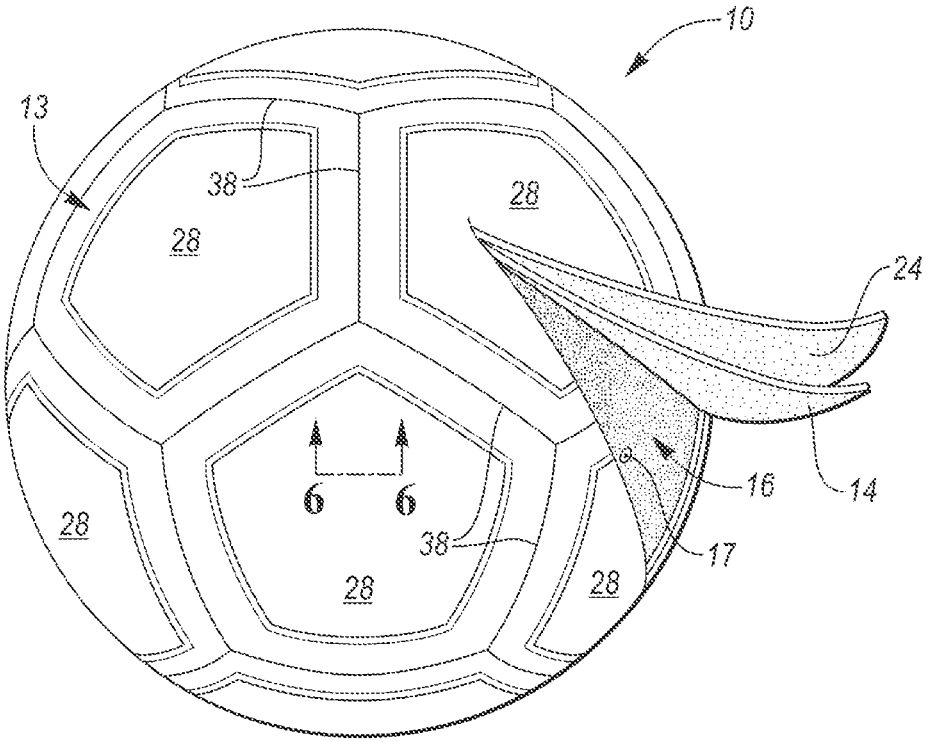
FIG. 2 is a schematic perspective view of an example inflatable sports ball, wherein the ball includes an interior bladder and a cover, the cover including an outer substrate and an intermediate structure.
Figure 3:
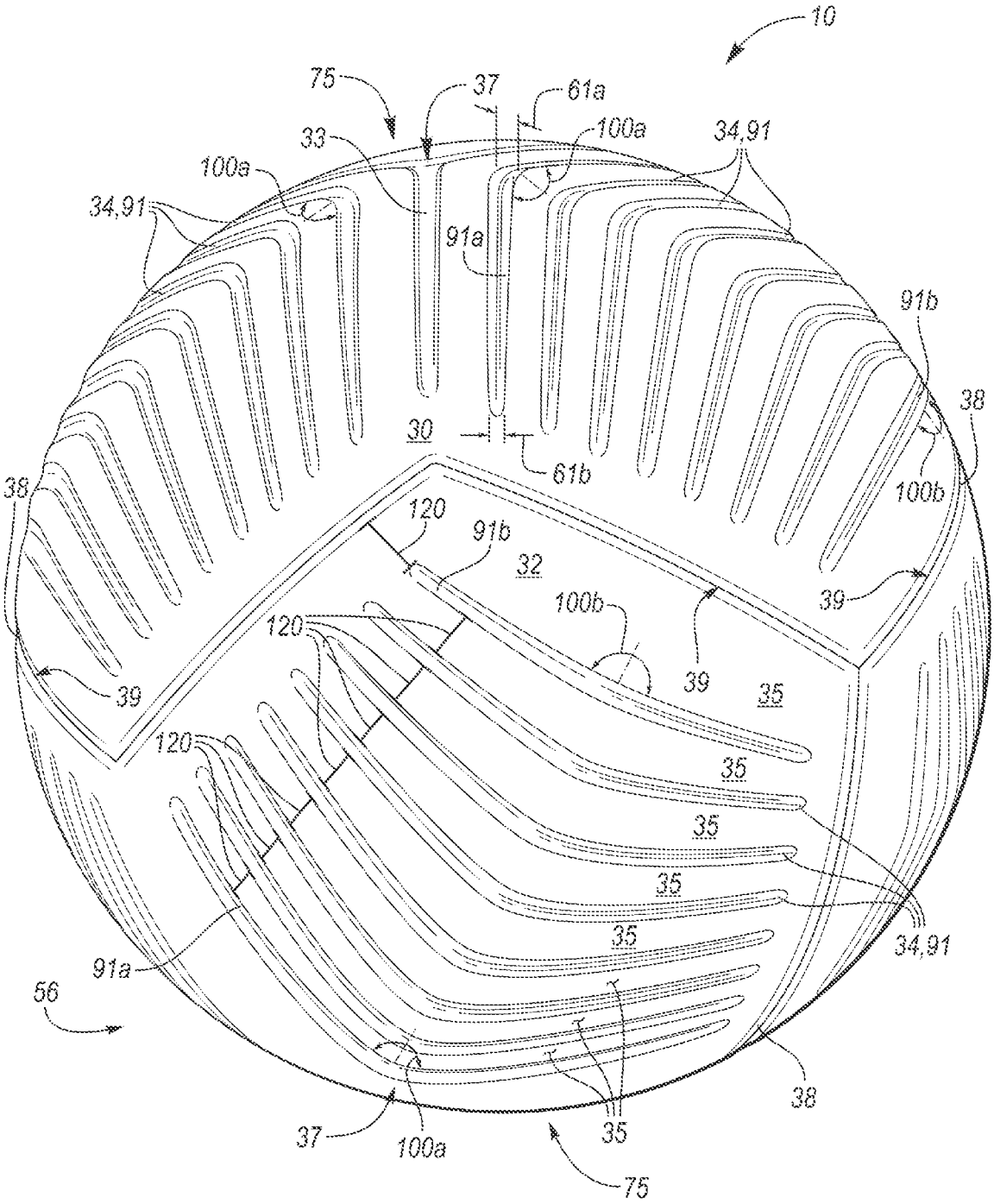
FIG. 3 is a schematic perspective view of one example inflatable sports ball, wherein the cover includes a plurality of indentations, which cooperate to define a topographical design on the exterior surface of the inflatable sports ball.

As shown in FIGS. 1-3, the sports ball 10 may be an inflatable sports ball such as a soccer ball or the like or a non-inflatable sports ball 10 such as a softball or the like. A sports ball 10 having the general configuration of a soccer ball is depicted in FIGS. 1-3. As shown in FIGS. 1 and 2, the sports ball 10 may have a layered structure including a cover 12 and an interior 16 (FIGS. 2 and 5-7). The cover 12 forms an exterior portion of the sports ball 10. The interior 16 forms an interior portion of sports ball 10.

Figure 6:
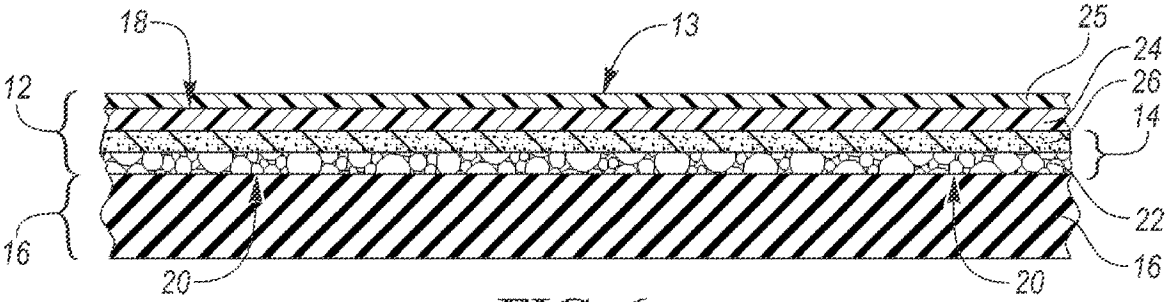
FIG. 6 is an example cross-section view of the cover shown in FIG. 2, taken along line 6-6.

In a non-inflatable example configuration of the sports ball 10, the interior 16 may be one of a solid mass and a hollow mass, fixed in size. In an inflatable example configuration of the sports ball 10, the interior 16 may be an interior bladder (FIGS. 2 and 6). In the inflatable example configuration, in order to facilitate inflation (i.e., fill the interior with pressurized air), the interior 16 generally includes a valved opening 17 that extends through the cover 12, thereby being accessible from the exterior surface 13 of the sports ball 10. Upon inflation, the bladder 16 is pressurized and the pressurization induces the exterior surface 13 to be a substantially spherical surface as the sports ball 10 takes on a substantially spherical shape. More particularly, pressure within the bladder 16 causes the bladder 16 to place an outward force upon the cover 12 on an inner substrate surface 20.

The cover 12 forms an exterior portion of the sports ball 10 and defines an exterior surface 13. The term cover 12 is meant to include any layer of the sports ball 10 that surrounds the interior 16. Thus, the cover 12 has a thickness 88 and may include both the outermost layer and also any intermediate layers, which are disposed between the interior 16 and the exterior surface 13. As shown in FIGS. 2 and 5-8G, the cover 12 may be composed as a layered structure including an outer substrate layer 24 and an intermediate structure 14 located interior to the outer substrate layer 24 between the outer substrate layer 24 and the interior 16. The outer substrate layer 24 defines an outer substrate surface 18. The inner substrate surface 20 is disposed opposite the outer substrate surface 18, and may be disposed adjacent to the ball interior 16.

In some embodiments, the outer substrate layer 24 may be composed of a polymeric material, a polymer foam material, or the like. Examples of suitable polymer materials include, but are not limited to, polyurethane, polyvinylchloride, polyamide, polyester, polypropylene, polyolefin, and the like.

The intermediate structure 14 may include a first intermediate cover layer 26 and a second intermediate cover layer 22. The first intermediate cover layer 26 is positioned between the outer substrate layer 24 and the second intermediate cover layer 22. The second intermediate cover layer 22 is positioned between the first intermediate cover layer 26 and the interior bladder 16. The second intermediate cover layer 22 may include the inner substrate surface 20, wherein the inner substrate surface 20 is positioned adjacent to the ball interior 16.

The respective cover layers 22, 26 of the intermediate structure 14 may be composed of a polymeric material, a polymer foam material, a foam material, textiles, or the like. Examples of suitable polymer materials include, but are not limited to, polyurethane, polyvinylchloride, polyamide, polyester, polypropylene, polyolefin, and the like. Examples of suitable polymer foam materials include, but are not limited to, polyurethane, ethylvinylacetate, and the like. Examples of suitable textile materials include, but are not limited to, a woven or knit textile formed from polyester, cotton, nylon, rayon, silk, spandex, or a variety of other materials. A textile material may also include multiple materials, such as a polyester and cotton blend. The intermediate structure 14 may further provide a softened feel to the sports ball, impart energy return, and restrict expansion of bladder 16, in an inflatable sports ball 10 example. In one example, the outer substrate layer 24 may be formed of a thermoplastic polyurethane material (TPU), the first intermediate cover layer 26 may be formed from a polymer foam material, and the second intermediate cover layer 22 may be formed from a textile material.

As shown in FIG. 6, the cover may further include an external surface layer 25 disposed upon the outer substrate surface 18 of the cover 12. The external surface layer 25 may be a film that includes a pigment or a graphic thereon. The external surface layer 25 may also be an outer film or a clear coat having weather resistant properties. The external surface layer 25 may be a polyurethane film or the like. The external surface layer 25 may be bonded to the outer substrate surface 18 via a bonding material.

As shown in FIGS. 1-4, the cover 12 may be generally formed by a plurality of adjoining panels 28, wherein each panel 28 has a respective panel surface that defines a portion of the outer substrate surface 18. The plurality of panels 28 includes at least a first panel 30 having a first panel surface and a second panel 32 having a second panel surface. The plurality of panels 28 may comprise the conventional twelve (12) panels or any other number of panels 28, for example, four joined panels 28 each having nine edges 36 and having a generally triangular shape that is formed from three pentagons. The cover 12 may also exhibit a substantially uniform or unbroken configuration that does not include panels 28 joined at abutting edge areas 36 via seams 38, or includes fewer panels 28. Each panel 28 may have a panel center 37 and a panel limit 39, wherein the panel limit 39 runs adjacent the abutting edge areas 36.

As shown in FIGS. 3-5, 7-8G, the cover 12 may further define a first plurality of indentations 38 and a second plurality of indentations 34. The exterior surface 13 may define a plurality of plateau sections 35 disposed between the indentations 34, 38. More particularly, the plurality of plateau sections 35, the first plurality of indentations 38, and second plurality of indentations 34 are positioned on the respective panel 28, such that the plurality of plateaus 35, the first plurality of indentations 38, and second plurality of indentations 34 define a surface profile 45 that includes an alternating and repeating series of plateaus and indentations 34, 38.

Figure 4:
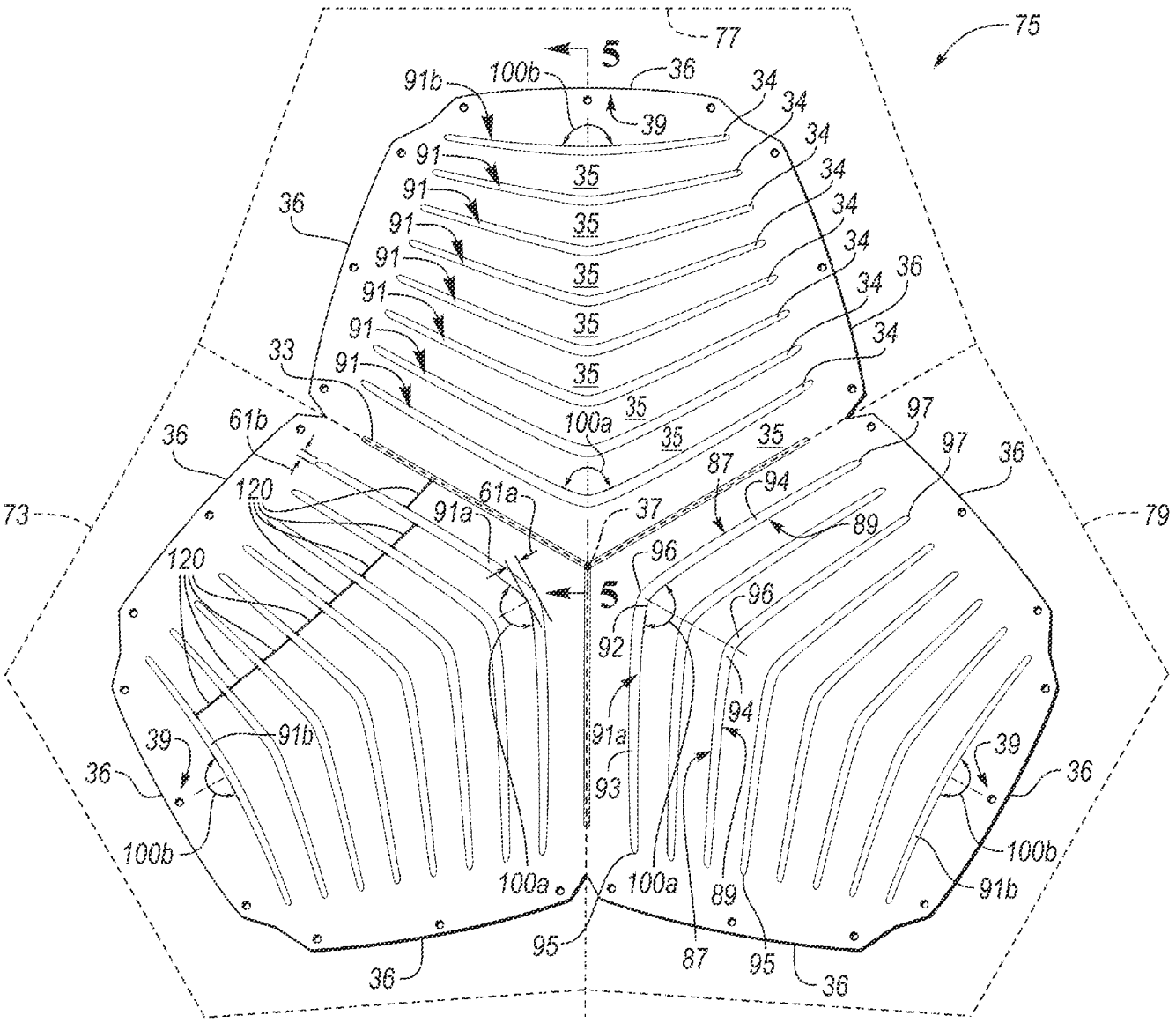
FIG. 4 is a schematic plan view of an example panel of a four-panel sports ball, wherein the example panel has a generally triangular shape that is formed from three pentagon-shaped subpanels.
Figure 5:
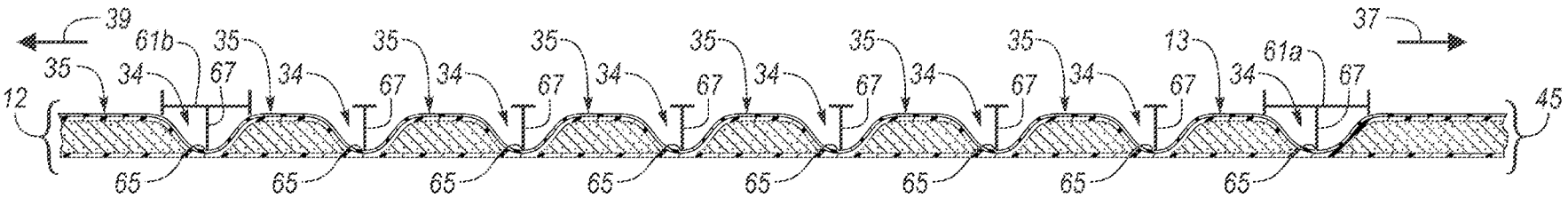
FIG. 5 is an example cross-section view of the panel shown in FIG. 4, taken along line 5-5.

Further, the plurality of plateaus 35, the first plurality of indentations 38, and second plurality of indentations 34 cooperate to define a topographical arrangement 56 across the exterior surface 13 of the cover 12. As shown in FIGS. 3-4, the topographical design 56 may be composed of a plurality of predefined panel arrangements, wherein a predefined panel arrangement 75 is defined as the orientation of the plateaus 35 and indentations 34, 38 on each of the respective panels 28. Each predefined panel arrangement 75 may be comprised a plurality of subpanel arrangements 73, 77, 79.

Figure 7:
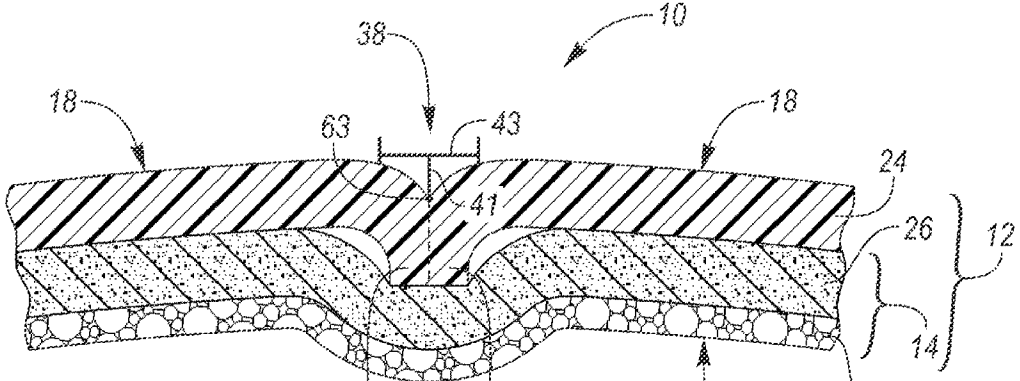
FIG. 7 is an enlarged, schematic, example cross-section of an indentation, wherein the indentation is defined as a seam, and shown in FIG. 1 taken along line 7-7.

As shown in FIG. 7, the first plurality of indentations 38 may have a first indentation terminus 63 radially-spaced apart from the outer substrate surface 18 in a direction toward the inner substrate surface 20. Further, each of the first plurality of indentations 38 has a first indentation depth 41 and a first indentation width 43. The first indentation terminus 63 is radially-spaced apart from the outer substrate surface 18 by the first indentation depth 41. Accordingly, each of the first plurality of indentations 38 may have a first maximum aspect ratio. The first maximum aspect ratio is defined as the ratio of the first indentation width 43 to the first indentation depth 41.

In one example, as shown in FIG. 7, the first plurality of indentations 38 may be defined as a plurality of seams 38 configured to couple the plurality of panels 28. The respective panels 28 may be adjoined together along abutting edge areas 36 (FIG. 4) via at least one seam 38 (FIGS. 1-3 and 7).

The panels 28 may be coupled along the abutting edge areas 36 by the seam 38 with stitching, bonding, welding, adhesives, or another suitable coupling method. As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material within at least one of the elements such that the materials of the elements are secured to each other when cooled. An example of welded seams 38 is disclosed in U.S. Pat. No. 8,608,599 to Raynak, et al., which is hereby entirely incorporated herein by reference. U.S. Pat. No. 8,608,599 to Raynak, et al. generally discloses examples of welded seams, in that welding generally produces a heat affected zone in which the materials of the two joined components are intermingled. This heat affected zone may be considered a "weld" or "thermal bond." Further, welding may involve (a) the melting or softening of two panels that include polymer materials such that the polymer materials from each panel intermingle with each other (e.g., diffuse across a boundary layer between the polymer materials) and are secured together when cooled, as well as (b) the melting or softening a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Further, welding may occur when only one panel includes a polymer material or when both panels include polymer materials.

In an example wherein each of the first plurality of indentations 38 is defined as a seam, the first indentation width 43 is a seam width and the first indentation depth 41 is a seam depth. Accordingly, each seam 38 may have a seam maximum aspect ratio being defined as the ratio of the seam width 43 to the seam depth 41. In one example, the seam depth may be greater than 0.5 millimeters, more particularly the seam depth 41 may be from about 0.5 millimeters to about 0.75 millimeters. The seam width 43 may be from about 0.5 centimeters to about 0.65 centimeters.

In another example, the first plurality of indentations 38 may be defined as debossed features, such as pseudo seams 33. The pseudo seams may be positioned in areas of the cover 12 that correspond with the positions of seams 38 in a conventional twelve panel or four panel sports ball 10, in order to impart the appearance of seams 38, when the cover 12 has a substantially uniform or unbroken configuration that does not include panels 28 or includes fewer panels 28. The pseudo seams 33 may be positioned in areas of the cover 12 that correspond with the positions of seams 38 in a conventional twelve panel or four panel sports ball 10, in order to impart the appearance of seams 38, when the cover 12 has a substantially uniform or unbroken configuration that does not include panels 28 or includes fewer panels 28. The pseudo seams 33 may also be positioned in other areas of the cover 12 that do not correspond with the positions of seams 38 in a conventional twelve panel or four panel sports ball 10, such as interior portions of the respective panels 28, as shown by example in FIGS. 3-4. In such an example, the first indentation width 43 is a pseudo seam width and the first indentation depth 41 is a pseudo seam depth. Accordingly, each pseudo seam 33 may have a pseudo seam maximum aspect ratio. The pseudo seam maximum aspect ratio may be defined as the ratio of the pseudo seam width 43 to the pseudo seam depth 41. The pseudo seam 33 may have substantially similar dimensions to that of a conventional seam 38, wherein the pseudo seam width is substantially similar to the seam width and wherein the pseudo seam depth is substantially similar to the seam depth. The pseudo seam depth may be greater than 0.5 millimeters, more particularly the pseudo seam depth may be from about 0.5 millimeters to about 0.75 millimeters. The pseudo seam width may be from about 0.5 centimeters to about 0.65 centimeters.

Further, the first plurality of indentations including any seams 38 and pseudo seams 33 may further define a first aggregate deboss length. The first aggregate deboss length is defined as a sum of all of the seam lengths and all of the pseudo seam lengths. In some example embodiments, the first aggregate deboss length may be from about 135 centimeters to about 150 centimeters. As shown in the examples in FIGS. 3-4, the first aggregate deboss length may be from about 140 centimeters to about 145 centimeters. More particularly, the first aggregate deboss length shown in the example of FIGS. 3 and 4 may be about 142 centimeters.

Referring to FIGS. 3-5 and 8A-8G, each of the second plurality of indentations 34 may have a second indentation terminus 65 radially-spaced apart from the outer substrate surface 18 in a direction toward the inner substrate surface 20. Further, each of the second plurality of indentations 34 has a second indentation depth 67 and a second indentation width 61. The second indentation terminus 65 is radially-spaced apart from the outer substrate surface 18 by the second indentation depth 67.

The second plurality of indentations 34 may be defined as a plurality of channels. In some example embodiments, the channels 34 may be spaced apart from the seams 38 of the sports ball 10. In other example embodiments, the channels 34 may extend to edges 36 of the panels 28 and, thus, continue across a respective seam 38. More particularly, a channel 34 on the first panel 30 and a channel 34 on the second panel 32 may be in substantial alignment with one another across a respective seam 38. This may also enable patterns, arrangements, or other designs to be carried across multiple panels, bridging seams 38 between the panels 28. Channels 34 may impart various advantages to ball 10. For example, channels 34 may enhance the aerodynamics of ball 10, provide a greater amount of consistency or control over ball 10 during play, e.g., during kicking, dribbling, or passing, improve ball feel, and provide for water channeling.

Channels 34 may be formed in the cover 12 via a variety of manufacturing processes including, but not limited to, debossing. Examples of a manufacturing process for forming channels 34 are disclosed in U.S. Pat. No. 9,370,693 to Berggren, et al., which is hereby entirely incorporated by reference herein. U.S. Pat. No. 9,370,693 to Berggren, et al. generally discloses a variety of manufacturing processes that may be utilized to form debossed features in the panels. In one example, one of the panels is located on a platen. A press plate is positioned above the platen and includes a protrusion having a predetermined shape. The protrusion presses into and heats the areas of the panel forming the debossed features. The press plate then moves away from the panel to substantially complete the formation of the debossed feature.

As shown in FIG. 8A-8G, each channel 34 has a channel terminus 65 that is radially-spaced apart from the outer substrate surface 18 in a direction toward the inner substrate surface 20. Further, each channel 34 has a channel depth 67 and a channel width 61. The channel terminus 65 is radially-spaced apart from the outer substrate surface 18 the channel depth 67. Accordingly, each channel 34 may have a channel maximum aspect ratio. The channel maximum aspect ratio is defined as the ratio of the maximum channel width 61*a* (FIG. 3) to the channel depth 67. The channel maximum aspect ratio is equal to the second maximum aspect ratio.

Referring to FIGS. 8A-8G, channels 34 are formed in the cover 12 and extend toward the interior 16. The intermediate structure 14 is positioned between outer substrate layer 24 and the interior bladder 16. The outer substrate layer 24 may be bonded to the intermediate structure 14 at the respective channel 34. More particularly, the outer substrate layer 24 may be welded directly to the second intermediate cover layer 22 at the channel terminus 65 of the respective channel 34 (FIGS. 8A-C and 8E-G), such that the outer substrate layer 24 extends through an entirety of the channel depth 67 at each channel 34.

The channel 34 may include an exterior indentation 82 and an interior indentation 84. The exterior indentation 82 has the terminus 65 that is radially-spaced apart from the outer substrate surface 18 by the channel depth 67.

Figure 8A:
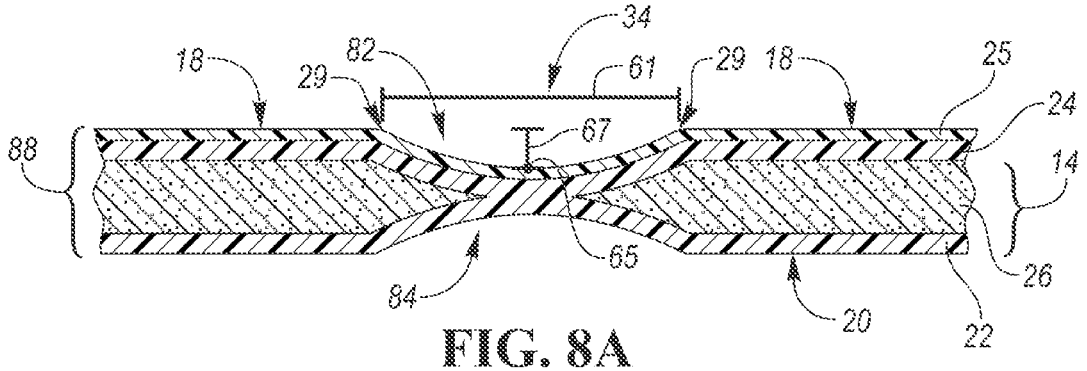
FIG. 8A is an enlarged, schematic, example cross sectional view of indentations, wherein the indentations are defined as channels.
Figure 8B:
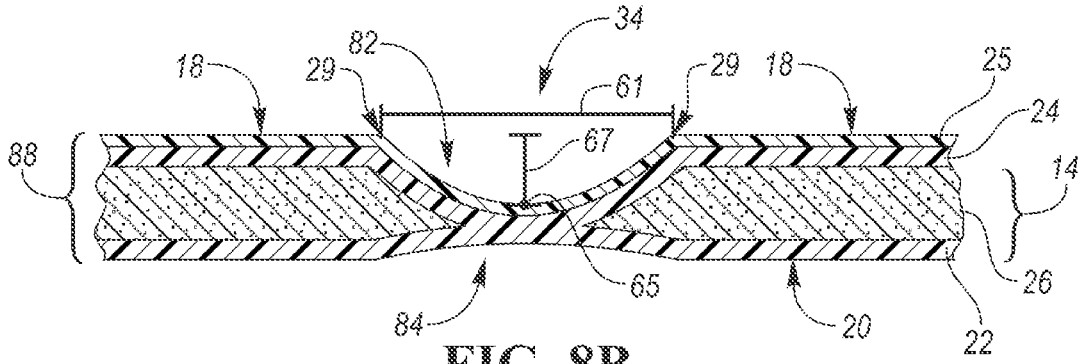
FIG. 8B is an enlarged, schematic, example cross sectional view of indentations, wherein the indentations are defined as channels.
Figure 8C:
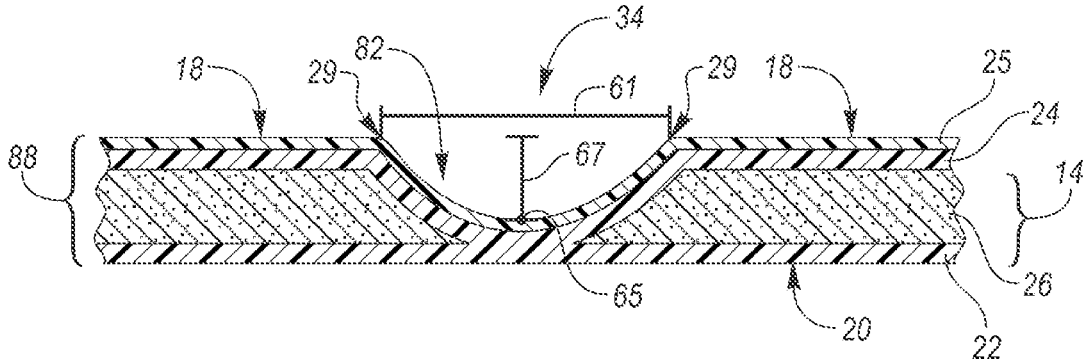
FIG. 8C is an enlarged, schematic, example cross sectional view of indentations, wherein the indentations are defined as channels.

The specific configuration of the channel 34 may vary considerably. Referring to FIG. 8A-8D, the exterior and interior indentations 82 and 84 may have a generally rounded configuration. As depicted in FIG. 8A the exterior and interior indentations 82 and 84 extend to an approximate midpoint of the thickness 88 of the panel cross-section. In another configuration, as depicted in FIGS. 8B and 8C, the exterior indentation 82 extends through more of the thickness 88 of panel cross section than the interior indentation 84. In yet another configuration, as depicted in FIG. 8C, the exterior indentation 82 extends through substantially all of the thickness 88 of panel cross-section. As also shown in FIG. 8C, in some embodiments, the second intermediate cover layer 22 may have a substantially planar configuration opposite the exterior indentation 82. Said another way, in some embodiments, the channel 34 may have only an exterior indentation 82 and no interior indentation 84.

Figure 8D:
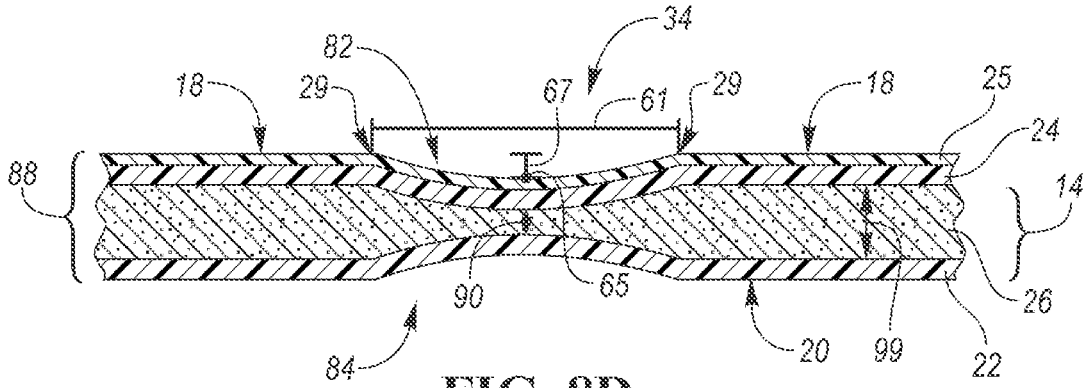
FIG. 8D is an enlarged, schematic, example cross sectional view of indentations, wherein the indentations are defined as channels.

Referring to FIG. 8D, indentations 82 and 84, as well as the outer substrate layer 24 and the second intermediate cover layer 22, may be spaced from each other, such that a portion of the first intermediate cover layer 26 extends between indentations 82 and 84 and between the outer substrate layer 24 and the second intermediate cover layer 22. In this configuration, the outer substrate layer 24 is bonded to the first intermediate cover layer 26 at the channel 34. In such an example, the first intermediate cover layer 26 has a first thickness 90 between indentations 82 and 84 and at the terminus 65 of the exterior indentation 82. In the same example, the first intermediate cover layer 26 has a second thickness 99 between the outer substrate layer 24 and the second intermediate cover layer 22, in an area spaced apart from indentations 82 and 84 and the terminus 65 of the exterior indentation 82, e.g., at a plateau 35. As shown in FIG. 8D, the first thickness 90 is less than the second thickness 99.

Figure 8E:
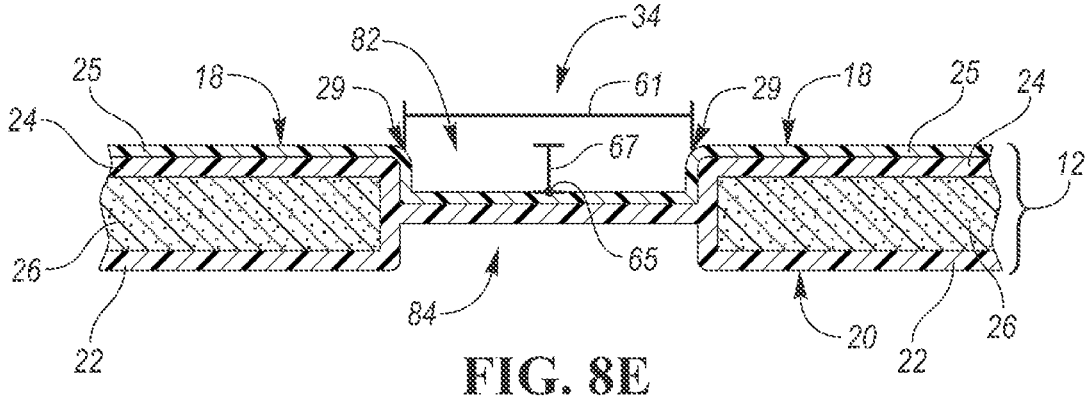
FIG. 8E is an enlarged, schematic, example cross sectional view of indentations, wherein the indentations are defined as channels.
Figure 8F:
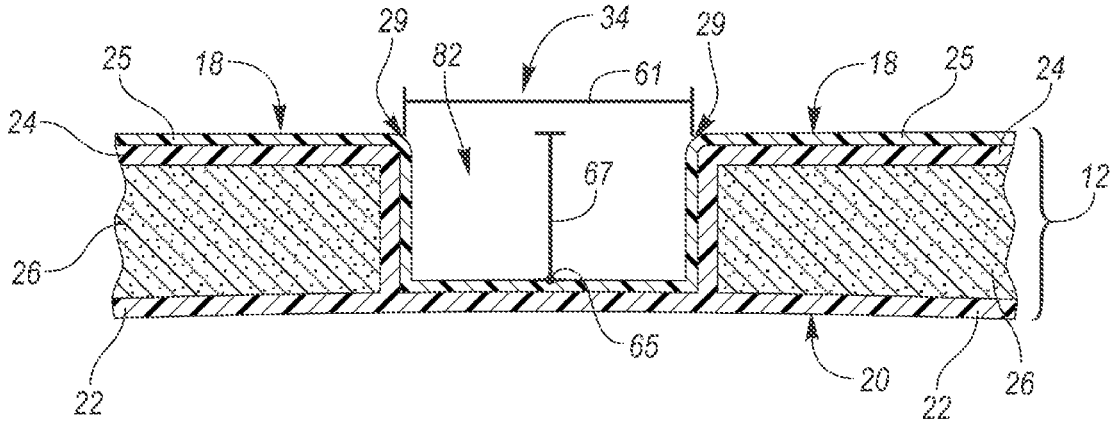
FIG. 8F is an enlarged, schematic, example cross sectional view of indentations, wherein the indentations are defined as channels.
Figure 8G:
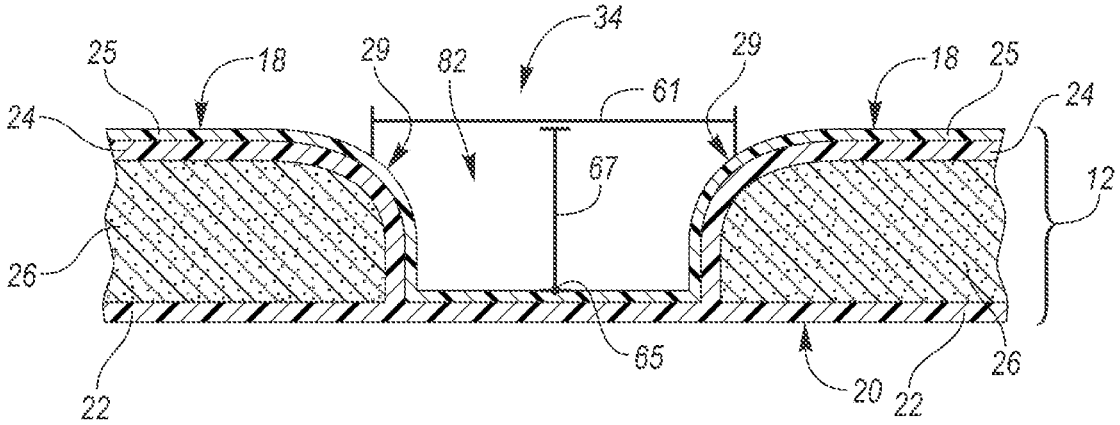
FIG. 8G is an enlarged, schematic, example cross sectional view of indentations, wherein the indentations are defined as channels.

Alternatively, the channels 34 may include an exterior indentation 82 and an interior indentation 84 that exhibit substantially squared configurations (FIGS. 8E-8G). For example, in some embodiments, the indentations 82, 84 may have substantially squared cross-sectional configurations. Such substantially squared cross-sectional configurations may have a more distinct appearance than indentations 82, 84 having substantially rounded cross-sectional configurations. In addition, substantially squared indentations 82, 84 may also provide performance benefits such as aerodynamics, ball feel, and water channeling.

As shown in FIG. 8E, the exterior indentation 82 and interior indentation 84 are two opposing indentations having substantially squared cross-sectional configurations. In FIG. 8E, the indentations 82 and 84 extend to an approximate midpoint of the thickness 88 of the panel cross-section, such that the terminus 65 of the exterior indentation 82 is positioned radially inward from the exterior surface 13 to the approximate midpoint of the thickness 88 of the panel cross-section.

In FIGS. 8F-8G, the exterior indentation 82 may extend through substantially the entirety of the thickness 88 of the panel cross section. As also shown in FIG. 8F-8G, in some embodiments, second intermediate cover layer 22 may have a substantially planar configuration opposite the exterior indentation 82. Said another way, in some embodiments, the channel 34 may have only an exterior indentation 82 and no interior indentation 84.

As shown in FIG. 8G, in one example embodiment, the debossed feature 34 may include substantially-squared exterior indentation 82 having a rounded shoulder portion 29. In some embodiments, a substantially-squared shoulder portion 29 may have a minimal radius, as shown in FIG. 8F. In another example embodiment, a rounded shoulder portion 29 having a larger radius may be used, as shown in FIG. 8G.

The second plurality of indentations, i.e., the channels 34 may further define a second aggregate deboss length. The second aggregate deboss length is defined as a sum of all of the channel lengths. In some example embodiments, the second aggregate deboss length may be greater than 800 centimeters. More particularly, the second aggregate deboss length may be from about 850 centimeters to about 1050 centimeters. In the example shown in FIGS. 3 and 4 the second aggregate deboss length may be about 950 centimeters.

The sports ball 10 may further have an aggregate feature length, which is defined as the sum of the first aggregate deboss length (total length of all the first plurality of indentations, e.g., the seams 38 and pseudo seams 33) and the second aggregate deboss length (total length of all channels 34). In example embodiments, the aggregate feature length may be greater than 800 centimeters. In the example shown in FIGS. 3 and 4, the aggregate feature length is from about 1000 centimeters to about 1200 centimeters, wherein the first plurality of indentations 33, 38 and the second plurality of indentations 34 cooperate to cover approximately 55%-70% of the exterior surface 13 of the cover 12.

Increased aggregate feature length and increased surface coverage of the exterior surface by the indentations 33, 34, 38 creates positive flight characteristics (consistency and length of trajectory) and enhances the aerodynamics of ball 10, i.e., reducing aerodynamic drag on the ball for better accuracy, consistency, and increased velocity. Due to increased aggregate feature length and increased surface coverage of the exterior surface 13 by the indentations 33, 34, 38, it is more likely that the boundary layer of air surrounding the of the sports ball 10 in flight will undergo the transition from laminar to turbulent flow, resulting in enhanced flight characteristics and aerodynamic properties.

However, if aggregate feature length and the percentage of the exterior surface 13 occupied by the indentations 33, 34, 38 are increased beyond a critical point, such that the indentations do not maintain enough predefined distance 120 therebetween, softness and ball feel characteristics may be diminished. The smaller the predefined distance 120 between two respective indentations the harder the ball surface at the respective measurement point; however, indentations with a lower cross-sectional area, may be placed closer together than indentations with a higher cross-sectional area, and still maintain desired softness and ball feel characteristics. As such, it is desirable to arrange the indentations 33, 34, 38 on the outer substrate surface 18 in a topographical arrangement 56 to balance increased aggregate feature length and surface coverage of the exterior surface 13 by the indentations 33, 34, 38 to enhance consistency and the aerodynamic properties of the ball 10 without sacrificing softness and ball feel characteristics. In one example, acceptable minimum predefined distances 120 between indentations to maintain desired softness and ball feel characteristics may be greater than 9.0 millimeters.

Referring again to FIGS. 3-4, in the present disclosure the channels 34, seams 38, pseudo seams 33, and the plateau sections 35 cooperate to define topographical arrangement 56 across a majority of the outer substrate layer 24 of the cover 12. In the example embodiments shown in FIGS. 3-4, each channel 34 comprises a first boundary 87 and a second boundary 89, such that the second indentation width 61 is disposed between the first boundary 87 and the second boundary 89. Each of the first boundary 87 and the second boundary 89 of the respective channel 34 border plateau sections 35. Further, each channel 34 is formed as a chevron element 91.

The chevron element 91 includes a first section 93 and a second section 94, each disposed between the respective first boundary 87 and second boundary 89. The first section 93 has a first section central end 92 and a first section distal end 95. The second section 94 has a second section central end 96 and a second section distal end 97. The first section central end 92 is connected to the second section central end 96 at a chevron angle 100. The chevron angle 100 is less than 180 degrees. More particularly, the chevron angle 100 is greater than 90 degrees and less than 180 degrees. Accordingly, the first section 93 is obliquely angled with respect to the second section 94.

In one example as shown in FIGS. 3 and 4, the channel width 61 may be variable between the first section central end 92 and the first section distal end 95. Further the channel width 61 may be variable between the second section central end 96 and the second section distal end 97. Accordingly, the channel width 61 may be expressed as a first channel width 61*a* (the maximum channel width) measured at the chevron angle 100 of the respective channel 34 and a second channel width 61*b* measured at the distal ends 95, 97 of the first section 93 and the second section 94 of the respective chevron element 91. As shown in FIGS. 3 and 4, the first channel width 61*a* (the maximum channel width) measured at the chevron angle 100 is greater than the second channel width 61*b* measured at the respective distal ends 95, 97 of the first section 93 and the second section 94. In one example, the first channel width 61*a* may be greater than 0.8 centimeters and the channel depth 67 may be greater than 0.7 millimeters. In the example shown in FIGS. 3 and 4, the first channel width 61*a* may be from about 0.8 centimeters to about 0.95 centimeters, and the channel depth may be from about 0.7 millimeters to about 1.0 millimeters. Further, in the example shown in FIGS. 3 and 4, the channel may have a channel cross-sectional area of from about 2.9 square millimeters to about 3.0 square millimeters at the chevron angle 100.

The second maximum aspect ratio is defined as the ratio of the second indentation width 61 to the second indentation depth 67 measured at the chevron angle 100. Said another way, the second maximum aspect ratio is a channel aspect ratio. The second maximum aspect ratio or channel aspect ratio is always greater than the first maximum aspect ratio or the maximum seam aspect ratio.

The channel aspect ratio may be variable between the first section central end 92 and the first section distal end 95.

Further the channel aspect ratio may be variable between the second section central end 96 and the first section distal end 95. The maximum channel aspect ratio is further defined as the ratio of the first channel width 61*a* and the channel depth 67 measured at the chevron angle 100. The channel minimum aspect ratio is further defined as the ratio of the second channel width 61*b* to the channel depth 67 measured at the distal ends 95, 97 of the first section 93 and second section 94 of the respective chevron element 91. The maximum channel aspect ratio is greater than the minimum channel aspect ratio. The minimum channel aspect ratio may be greater than the first maximum aspect ratio or seam aspect ratio, as shown in FIGS. 3-7.

Referring again to FIGS. 3-5, the chevron-shaped 91 channels 34 and the plateau sections 35 cooperate to define topographical arrangement 56 across a majority of the exterior surface 13 of the cover 12. The example topographical design 56 shown in FIG. 3 promotes a balanced design across the exterior surface 13 ball 10. A balanced topographical design 56, avoids uneven lift of the ball 10 and improves consistency of the ball 10 when kicked in any orientation. Ball 10 consistency is one property that is often commented on by players. The most consistent balls are the ones with the optimum combination of amplitude and frequency of the varying force coefficients relative to the amount of spin. As such, the tailoring of the topographical design 56 on the ball 10 may allow for optimization of consistency and improved aerodynamics.

As shown in FIGS. 3 and 4, the topographical design 56 may be composed of a plurality of predefined panel arrangements, wherein a predefined panel arrangement 75 is defined as the orientation of the plateaus 35 and chevron elements 91 on each of the respective panels 28. Each predefined panel arrangement 75 may be comprised a plurality of subpanel arrangements 73, 77, 79. In the example shown in FIGS. 3 and 4, the topographical design 56 is composed of a plurality of panels 28, namely, four panels, each having the same predefined panel arrangement 75. The predefined panel arrangement 75 is composed of three substantially similar subpanel arrangements 73, 77, 79. Each subpanel arrangement 73, 77, 79 of the example four panel ball 10 would correspond to a single predefined panel arrangement 75 on a conventional twelve panel ball 10.

Each subpanel arrangement 73, 77, 79 includes the chevron elements 91 of the plurality of channels 34 and alternating plateau sections 35. As shown in FIGS. 3 and 4, the respective subpanel arrangements 73, 77, 79 comprise an alternating and repeating series of plateaus 35 and chevron elements 91 extending between the panel center 37 and the panel limit 39.

Each respective subpanel arrangement 73, 77, 79 includes a first chevron element 91*a* having a first chevron angle 100*a*. The first chevron element 91*a* is proximate to the panel center 37. Each respective subpanel arrangement 73, 77, 79 may further include at least a second chevron element 91*b* having a second chevron angle 100*b*. The second chevron element 91*b* is proximate to the panel limit 39, as shown in FIG. 4. While the chevron angle 100 is always less than 180 degrees, the chevron angle 100 gets larger or more obtuse as the chevron elements 91 move from the panel center 37 to the panel limit 39. As such, the first chevron angle 100*a* is more acute than the second chevron angle 100*b*. Said another way, the first chevron angle 100*a* is smaller than the second chevron angle 100*b*.

The respective subpanel arrangements 73, 77, 79 may comprise from about seven plateau sections 35 and six corresponding chevron-shaped 91 channels 34 to about eleven plateau sections 35 and ten corresponding chevron-shaped 91 channels 34. In the example shown in FIGS. 3 and 4, the respective subpanel arrangements 73, 77, and 79 comprise an alternating and repeating series of nine plateau sections 35 and eight chevron-shaped 91 channels 34.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An inflatable sports ball comprising:

an interior bladder;

a cover disposed about the interior bladder, the cover comprising a plurality of adjoining panels and defining:

an exterior surface;

a first plurality of indentations having a first indentation depth, a first indentation width, and a first maximum aspect ratio, wherein the first maximum aspect ratio is defined as a ratio of the first indentation width to the first indentation depth;

a second plurality of indentations having a second indentation depth, a second indentation width, and a second maximum aspect ratio, wherein each the second plurality of indentations further comprises a chevron element, the chevron element including:

a first section having a first section central end and a first section distal end;

a second section having a second section central end and a second section distal end, wherein the first section central end is connected to the second section central end at a chevron angle that is greater than 90 degrees and less than 180 degrees;

a plurality of plateaus disposed between the chevron elements, wherein the plateaus and the chevron elements form an alternating and repeating series of the plateaus and the chevron elements on each of the respective panels, extending from a panel center to a panel limit;

wherein the second maximum aspect ratio is defined as a ratio of the second indentation width to the second indentation depth, and wherein the second maximum aspect ratio is greater than the first maximum aspect ratio; and wherein the first plurality of indentations defines a first aggregate deboss length and the second plurality of indentations defines a second aggregate deboss length, and the first plurality of indentations and the second plurality of indentations further define an aggregate feature length, such that the aggregate feature length is defined as a sum of the first aggregate deboss length and the second aggregate deboss length, and wherein the aggregate feature length is greater than 1000 centimeters.

2. The inflatable sports ball of claim 1 wherein:

the first indentation width is from about 0.5 centimeters to about 0.65 centimeters and the first indentation depth is from about 0.5 millimeters to about 0.75 millimeters; and the second indentation width is from about 0.8 centimeters to about 0.95 centimeters and the second indentation depth is from about 0.7 millimeters to about 1.0 millimeters.

3. The inflatable sports ball of claim 2 wherein the first plurality of indentations defines a first aggregate deboss length and the second plurality of indentations defines a second aggregate deboss length; and wherein the first aggregate deboss length is from about 135 centimeters to about 150 centimeters, and the second aggregate deboss length is from about 850 centimeters to about 1050 centimeters.

4. The inflatable sports ball of claim 3 wherein the first aggregate deboss length is from about 140 centimeters to about 145 centimeters, and the second aggregate deboss length is about 950 centimeters.

5. The inflatable sports ball of claim 4 wherein the first plurality of indentations and the second plurality of indentations cooperate to define from about 55% to about 70% of the exterior surface of the cover.

6. The inflatable sports ball of claim 1 wherein each of the chevron elements comprises a first boundary and a second boundary, such that the second indentation width is disposed between the first boundary and the second boundary; and wherein each of the chevron elements is spaced apart from each of the other chevron elements and each of the first plurality of indentations by a minimum predefined distance, and wherein the minimum predefined distance is greater than 9 millimeters.

7. The inflatable sports ball of claim 6 wherein:

the second indentation width is defined as at least one of a first chevron element width measured at the chevron angle, and a second chevron element width measured at one of the distal end of the first section or the distal end of the second section of the respective chevron element; and the first chevron element width is greater than the second chevron element width.

8. The inflatable sports ball of claim 7 wherein:

the second maximum aspect ratio is defined as a ratio of the first chevron element width to the second indentation depth measured at the chevron angle;

each chevron element has a minimum aspect ratio defined as the ratio of the second chevron element width to the second indentation depth measured at the distal end of the first section and the distal end of the second section of the respective chevron element; and the second maximum aspect ratio is greater than the minimum aspect ratio of each chevron element.

9. The inflatable sports ball of claim 1 wherein:

the alternating and repeating series of plateaus and chevron elements includes a first chevron element proximate the panel center having a first chevron angle and a second chevron element proximate the panel limit having a second chevron angle; and the first chevron angle is more acute that the second chevron angle.

10. An inflatable sports ball comprising:

an interior bladder;

a cover disposed about the interior bladder, the cover comprising a plurality of adjoining panels and defining:

an exterior surface defining a plurality of plateaus;

a plurality of peripheral seams between adjoining ones of the plurality of adjoining panels, each seam having a seam terminus radially spaced apart from the exterior surface by a seam depth of from about 0.5 millimeters to about 0.75 millimeters, a seam width of from about 0.5 centimeters to about 0.65 centimeters, and a seam maximum aspect ratio, wherein the seam maximum aspect ratio is defined as a ratio of the seam width to the seam depth, and wherein the plurality of peripheral seams defines a first aggregate deboss length of from about 135 centimeters to about 150 centimeters;

a plurality of channels having a channel terminus radially spaced apart from the exterior surface by a channel depth of from about 0.7 millimeters to about 1.0 millimeters, a channel width of from about 0.8 centimeters to about 0.95 centimeters, and a channel maximum aspect ratio, wherein the channel maximum aspect ratio is defined as a ratio of the channel width to the channel depth, wherein the plurality of channels defines a second aggregate deboss length from about 850 centimeters to about 1050 centimeters, each of the channels further comprising a chevron element, wherein the chevron element includes:

a first section having a first section central end and a first section distal end;

a second section having a second section central end and a second section distal end, wherein the first section central end is connected to the second section central end at a chevron angle that is greater than 90 degrees and less than 180 degrees, such that the first section is obliquely angled with respect to the second section wherein the chevron elements and the plateaus are arranged in a predefined panel arrangement on each of the respective panels, and wherein each predefined panel arrangement is comprised of a plurality of subpanel arrangements, wherein each subpanel arrangement includes an alternating and repeating series of the plateaus and the chevron elements extending from a panel center to a panel limit, such that the alternating and repeating series of the plateaus and the chevron elements includes at least a first chevron element closer to the panel center than the panel limit having a first chevron angle and a second chevron element that is closer to the panel limit than the panel center having a second chevron angle;

wherein the first chevron angle is more acute than the second chevron angle; and wherein channel maximum aspect ratio is defined as the ratio of the channel width to the channel depth measured at the chevron angle, and wherein the channel maximum aspect ratio is greater than the seam maximum aspect ratio.

11. The inflatable sports ball of claim 10 wherein:

the plurality of seams and the plurality of channels further define an aggregate feature length;

the aggregate feature length is defined as a sum of the first aggregate deboss length and the second aggregate deboss length;

wherein the aggregate feature length is greater than 1000 centimeters; and the plurality of seams and the plurality of channels cooperate to define from about 55% to about 70% of the exterior surface of the cover.

12. An inflatable sports ball comprising:

an interior bladder;

a cover disposed about the interior bladder, the cover comprising a plurality of adjoining panels and defining:

an exterior surface defining a plurality of plateaus;

a first plurality of indentations having a first indentation depth, a first indentation width, and a first maximum aspect ratio, wherein the first maximum aspect ratio is defined as a ratio of the first indentation width to the first indentation depth, and wherein the first plurality of indentations defines a first aggregate deboss length;

a second plurality of indentations defined as a plurality of channels, wherein the plurality of channels defines a second aggregate deboss length, and wherein each of the channels is spaced apart from each of the first plurality of indentations by a minimum predefined distance, each of the channels further comprising:

a chevron element having a first boundary and a second boundary, the chevron element further comprising a first section having a first section central end and a first section distal end and a second section having a second section central end and a second section distal end, wherein the first section central end is connected to the second section central end at a chevron angle of greater than 90 degrees and less than 180 degrees, such that the first section is obliquely angled with respect to the second section;

a channel depth;

a first channel width disposed between the first boundary and the second boundary and defined at the chevron angle and a second maximum aspect ratio defined as a ratio of the first channel width to the channel depth measured at the chevron angle;

a second channel width disposed between the first boundary and the second boundary and defined at the distal end of the first section and the distal end of the second section of the respective chevron element, and a minimum aspect ratio defined as the ratio of the second channel width to the channel depth measured at the distal end of at least one of the first section distal end or the second section distal end of the respective chevron element;

wherein the second maximum aspect ratio is greater than the first maximum aspect ratio;

wherein the first plurality of indentations and the plurality of channels further define an aggregate feature length, such that the aggregate feature length is defined as a sum of the first aggregate deboss length and the second aggregate deboss length, and wherein the aggregate feature length is greater than 1000 centimeters; and wherein the chevron elements and the plateaus are arranged in an alternating and repeating series of the plateaus and the chevron elements extending from a panel center to a panel limit.

13. The inflatable sports ball of claim 12 wherein:

the alternating and repeating series of plateaus and chevron elements includes a first chevron element proximate the panel center having a first chevron angle and a second chevron element proximate the panel limit having a second chevron angle; and the first chevron angle is more acute that the second chevron angle.

14. The inflatable sports ball of claim 12 and wherein the minimum predefined distance is greater than 9 millimeters.

15. The inflatable sports ball of claim 12 wherein:

the first indentation width is from about 0.5 centimeters to about 0.65 centimeters and the first indentation depth is from about 0.5 millimeters to about 0.75 millimeters; and the first channel width is from about 0.8 centimeters to about 0.95 centimeters, the second channel width is from about 0.8 centimeters to about 0.95 centimeters, and the channel depth is from about 0.7 millimeters to about 1.0 millimeters.

16. The inflatable sports ball of claim 12 wherein the first plurality of indentations defines a first aggregate deboss length and the second plurality of indentations defines a second aggregate deboss length; and wherein the first aggregate deboss length is from about 135 centimeters to about 150 centimeters, and the second aggregate deboss length is from about 850 centimeters to about 1050 centimeters.

17. The inflatable sports ball of claim 16 wherein the first aggregate deboss length is from about 140 centimeters to about 145 centimeters, and the second aggregate deboss length is about 950 centimeters.

18. The inflatable sports ball of claim 17 wherein the first plurality of indentations and the second plurality of indentations cooperate to define from about 55% to about 70% of the exterior surface of the cover.

* * * * *